US005342020A

United States Patent [19]

Stone

[11] Patent Number: 5,342,020

[45] Date of Patent: Aug. 30, 1994

[54] SPEED CONTROLLER FOR DRILLING RIG TRAVELING BLOCK

[76] Inventor: Richard J. Stone, P.O. Box 1367, Stafford, Tex. 77497

[21] Appl. No.: 695,529

[22] Filed: May 3, 1991

[51] Int. Cl.[5] ..... B66D 1/48

[52] U.S. Cl. ..... 254/269; 254/378

[58] Field of Search ..... 254/269, 375, 378, 379; 187/134; 175/24, 27; 173/11

[56] References Cited

U.S. PATENT DOCUMENTS

| | | | |
|---|---|---|---|
| 4,434,971 | 3/1984 | Cordrey | 254/275 |
| 4,524,952 | 6/1985 | Rome et al. | 254/269 |
| 4,591,131 | 5/1986 | Rhoads | 254/269 |
| 4,875,530 | 10/1989 | Frink et al. | 254/269 |

OTHER PUBLICATIONS

*Linear Displacemetn Transducer,* Description of unknown date.

*Primary Examiner*—Katherine Matecki

*Attorney, Agent, or Firm*—Vaden, Eickenroht, Thompson, Boulware & Feather

[57] ABSTRACT

A controller for a drilling rig traveling block is disclosed utilizing an absolute position locator and a processor for employing various operating fixed and variable parameters for controlling the speed of travel of the traveling block. As approach limits are reached in either the ascending or descending mode, the position input enters the calculations so that the traveling block is effectively controlled at high speed while safely avoiding an upward or a downward collision. Operation, once the parameter are inputted, is independent of operator control except for override operation.

56 Claims, 3 Drawing Sheets

SPEED CONTROLLER FOR DRILLING RIG TRAVELING BLOCK

BACKGROUND OF THE INVENTION

1. Field of the Invention

This invention pertains to the drawworks for oil drilling rigs and more specifically to a computer controlled system for controlling either or both the upward and the downward speed of the load bearing traveling block assembly, especially as it approaches one of its traveling limits.

2. Description of the Prior Art

It is well known in the oil drilling art (which includes drilling for gas as well as for oil) to utilize a drawworks in connection with the oil drilling rig or derrick to hold and to raise and lower, as desired, a drill string into and out of the associated well bore. Generally, the raising and lowering operation is accomplished by means of a traveling block having an appropriate hook or other similar assembly. The traveling block is secured in block-and-tackle fashion to a stationarily secured crown block or other limit fixture located at the top of the well derrick or rig. Although the load bearing assembly could take another form in a particular drilling rig embodiment, for purposes herein all such load bearing assemblies regardless of appearance are, for convenience, referred to as the "traveling block", which term also includes the hook or other attachment means, the associated equipment or other load associated therewith as it moves upwardly and downwardly.

The raising and lowering operation of the traveling block is controlled by means of a hoist cable, line or rope, one end of which is secured to the rig floor, thereby forming a so-called "dead" line. The other end of such line is secured to the drawworks proper, thereby forming the "fast" line. This assembly is generally operated and controlled by an operator sometimes also referred to as "the driller".

The drawworks generally includes a rotatable cylindrical drum upon which the fast line is wound utilizing a suitable prime mover, which includes a power transmission assembly. Thus, in association with the raising of the traveling block, the prime mover is controlled by an operator, usually referred to as the "driller", by way of a foot or hand throttle. Similarly, in connection with the lowering operation, the drawworks is supplied with one or more suitable brakes, also controlled by the driller, usually with hand controls. Generally, the primary brake, which typically is a friction brake, is supplemented with an auxiliary brake, often of the eddy current type or a magnetic brake, which can be employed independently or together to control the rate of lowering the traveling block.

As mentioned, the drawworks is usually fitted with a primary friction brake, which generally is either a band or a disk type. Also as mentioned, either or both the primary and the auxiliary or secondary brake can be used together or independently to control the speed of the traveling block. When the traveling block is being lowered, speed control is principally by way of the auxiliary brake and the final stopping of the traveling block is by way of the primary brake. At all times, the brakes are operated or controlled by the driller.

It may be apparent from the description so far that, inasmuch as a typical load borne by the traveling block can be 400 tons or even more, an operational error by the operator or driller or a failure in any of the systems controlling the speed or rate of upward or downward movement of the traveling block could be hazardous and even catastrophic, resulting in damage to equipment, personal injury and even loss of human life.

Attempts at automating the drilling operation of raising and/or lowering the traveling block have taken many forms so as to remove human judgment or the possibility that human error might be the reason for a resulting damaging failure. For example, a simple governor on the prime mover would ensure that the throttle speed could not exceed a predetermined limit so as to reduce the margin of error at slowing and stopping the travel block at its upper limit of travel to prevent the traveling block from ramming the crown block.

U.S. Pat. No. 4,434,971, Codrey, which issued Mar. 6, 1984, discloses a load overspeed control system for preventing brake burnout that would otherwise be caused by allowing a loaded traveling block to ascend or descend too fast as it approaches the top or bottom of its travel path and then suddenly administering the brake. A load signal is developed by a load sensor attached to the dead line. A position signal is produced by a position encoder attached to the drawworks' drive shaft and a velocity signal is produced by differentiating the position signal. A digital computer is pre-loaded with information pertaining to the maximum energy absorbing capability of the primary brake. When the traveling block comes within a predetermined distance to the crown block or derrick floor at an excessive amount of speed for the load, an emergency signal is produced to activate an emergency brake to prevent primary brake burnout or a crash.

As noted above, the position measurement in the Cordrey system is developed from sensing the rotation of the drive shaft of the rotating drum of the drawworks. As a cable or line winds and unwinds from a drum, the amount of cable for each rotation will vary because of changes in circumference of the reel. Further, cable stretch will vary as the load increases or decreases. In short, the position signal and the velocity signal developed from such sensing is indirect and often inexact, introducing possible errors in calculations that can defeat the procedure, thereby causing the often disastrous results mentioned above. It is further noted that the Cordrey system also does not coordinate both braking systems in gradual slowdown fashion, but only kicks in a second brake when an emergency signal is produced. Additionally, in slowing and stopping the upward movement of the traveling block, a brake is operated to oppose the drive force initiated by the throttle and there is no automated throttle control.

Therefore, it is a feature of the present invention to provide improved speed control for slowing down and stopping the traveling block of a drilling rig as it approaches an upper limit and/or a lower limit.

It is another feature of the present invention to provide improved speed control for slowing down and stopping the traveling block of a drilling rig utilizing direct and absolute position sensing for developing position and speed signals.

It is still another feature of the present invention to provide improved speed control for slowing down and stopping the traveling block of a drilling rig utilizing a process controller preprogrammed with instructions for slowing down and stopping the traveling block within a specified upper range and/or a specified lower range depending on the speed and load of the traveling block at predetermined locations before such upper range and/or before such lower range.

SUMMARY OF THE INVENTION

The invention speed controller is connected to the prime mover of the traveling block of a drilling rig, the prime mover usually being included as part of the drawworks. In a preferred embodiment, the speed controller is connected to override the throttle control when appropriate to reduce upward movement of the traveling block and is connected to the brake systems of the drawworks to assist in stopping the traveling block within a predefined upper range and for slowing down and stopping the traveling block in its downward movement to stop it within one or two predefined lower ranges.

The position sensor includes an elongated protective sheath comprised of a series of sequentially oriented elongated segments that are bonded together between the segments. A conductor is located in each segment of the protective sheath, which sheath and conductors are vertically installed alongside the travel path of the traveling block. A generally U-shaped holder of a plurality of magnets, nominally 24 in a preferred embodiment, is attached to the traveling block and is positioned about the conductor sheath. The magnets are aligned in a horizontal plane to form a magnetic marker that produces an electro-magnetic force at the location of the marker and, thus, a reflection when the conductors are pulsed. One end of each conductor is connected to a transceiver that periodically produces a pulse down the conductors and receives a return reflection from the magnetic marker. In a preferred embodiment, a single interrogation pulse produces four consecutive pulse returns from the magnetic marker in the shape of one long pulse return. This long pulse return is divided by four to produce a single quotient output that is an average of the individual return pulses, which quotient output is a direct or absolute measure of the location of the traveling block and is the basis for an absolute position signal to the controller. An overlap of the conductors provides means for checking the marker's presence against two conductors as the marker crosses the overlapped ends.

The processor of the controller develops from changes in the position signal a speed signal. Finally, a suitable sensor is connected to the dead line of the drilling rig to develop a weight or load signal, which is applied to the processor.

Preprogrammed instructions are set into the processor concerning load and speed parameters for the traveling block to produce from the speed reduction control means portion of the processor suitable slowdown signals dependent on the actual speed and load existing at the time the traveling block is sensed at a predetermined distance from the predefined upper limit range or at a predetermined distance from a predefined lower limit range.

The production of a first slowdown signal for upward movement control is employed to override the throttle control and/or to apply braking, the signal being determined by how the applied speed, position and load parameters compare with the preprogramming instructions slower speed and a heavier load will produce a slowdown signal for lesser throttle reduction and/or braking than for a faster speed and a lighter load condition since the mass of the drum remains constant and the load of the traveling block is really a counterbalance to that drum mass.

The production of a second slowdown signal for downward movement control is used to apply appropriate braking from the primary and auxiliary braking systems, this signal in similar fashion being determined by what is required by preprogramming instructions when actual position, speed and load signals are applied to the processor. A faster speed and a heavier load will require more braking than a slower speed and a lighter load condition initiated when the traveling block is at a predetermined sensed position ahead of the lower limit range. Appropriate coordinated braking signals are produced to cause such results.

Other embodiments of the invention are provided that only control upward movement slowdown or only control lower movement slowdown. When a more complete control is desired, additional position sensing for the traveling block ahead of the upper limit range and/or lower limit range can be used to initiate slowdown control sooner and harder for extremely fast speed operation of the traveling block. Even the entire movement range can be thus controlled, if desired. The lower limit can be determined to avoid a crash by the traveling block into the drilling floor. However, in addition, the lower limit can also employ a signal from a sensor that determines how far the drill bit on the drill string is from the bottom of the hole. Thus, for systems so equipped, the lower limit can be whichever would occur first, contact between the traveling block and the drilling floor or contact between the drill bit and the bottom of the hole.

Visual indication of travel block location and audible alarm features can also be provided, if desired.

BRIEF DESCRIPTION OF THE DRAWINGS

So that the manner in which the above-recited features, advantages and objects of the invention, as well as others which will become apparent, are attained and can be understood in detail, more particular description of the invention briefly summarized above may be had by reference to the exemplary preferred embodiments thereof which are illustrated in the drawings, which form a part of this specification. It is to be noted, however, that the appended drawings illustrate only typical preferred embodiments of the invention and are not to be considered limiting of its scope as the invention may admit to other equally effective embodiments.

IN THE DRAWINGS

Figure 1:
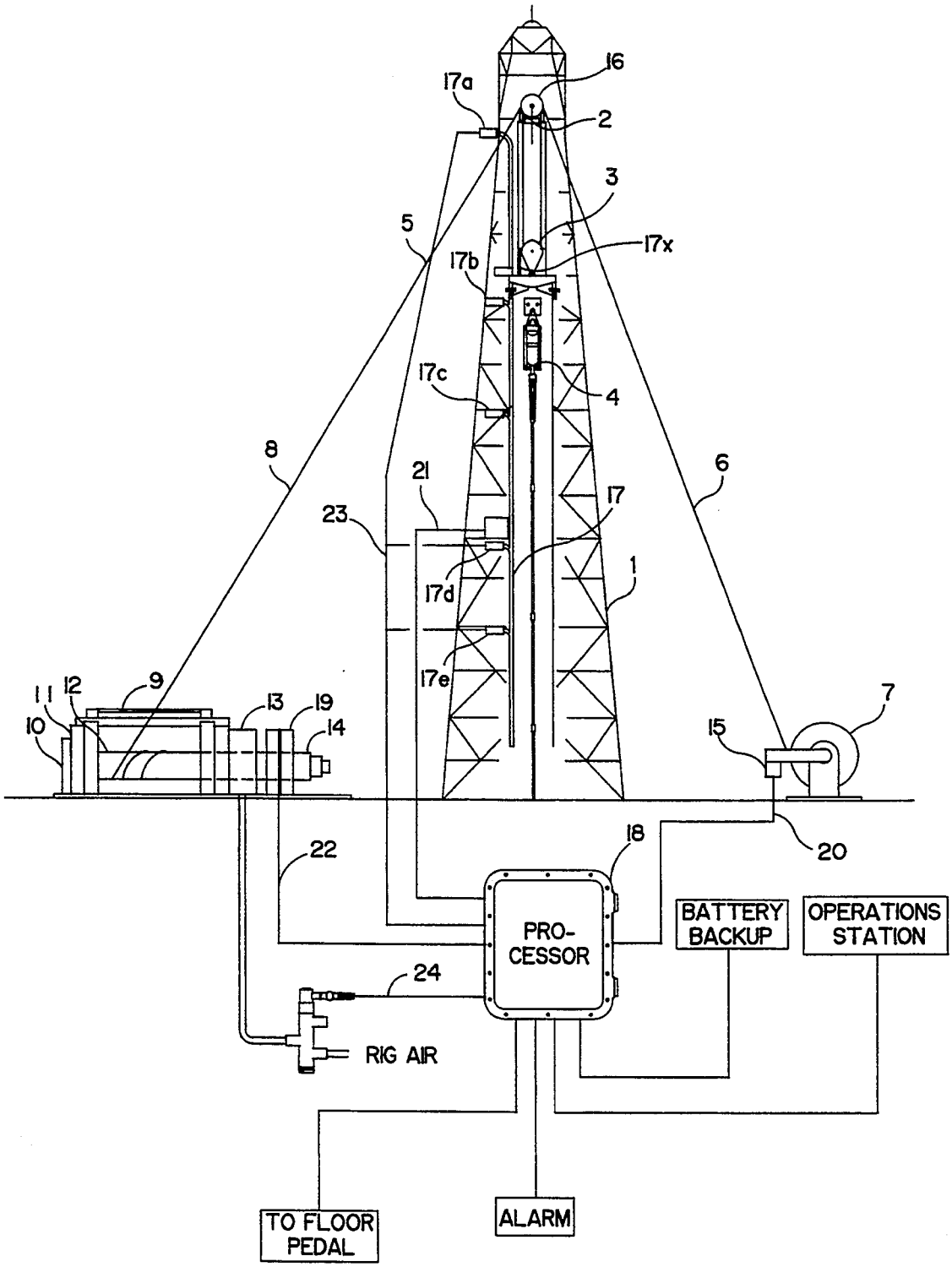

FIG. 1 is a mechanical schematic and an electrical block diagram of a typical drilling rig traveling block speed control system of the present invention.

Figure 2:
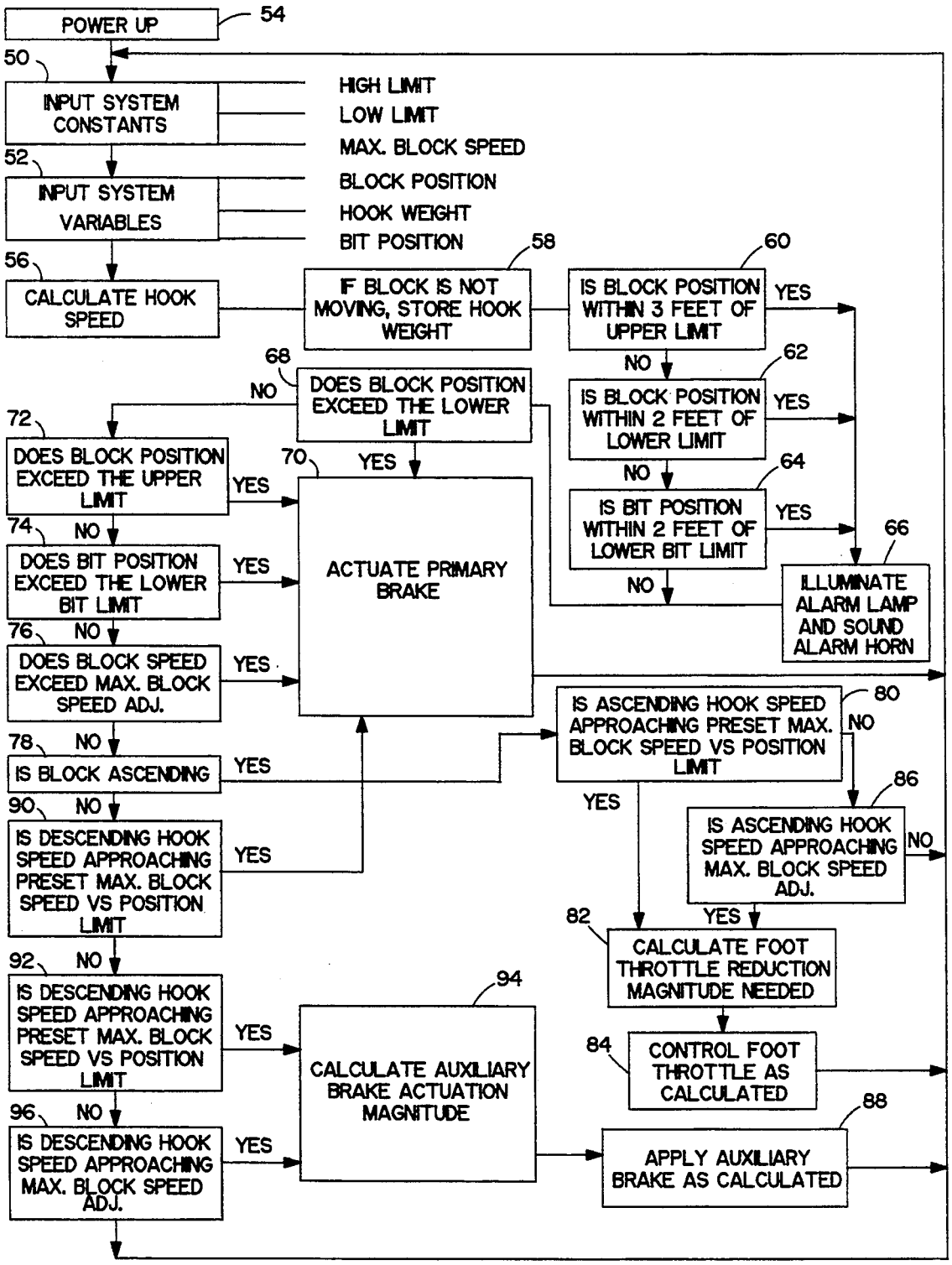

FIG. 2 is a flow diagram of a preferred embodiment of the traveling block controller program of the present invention.

Figure 3:
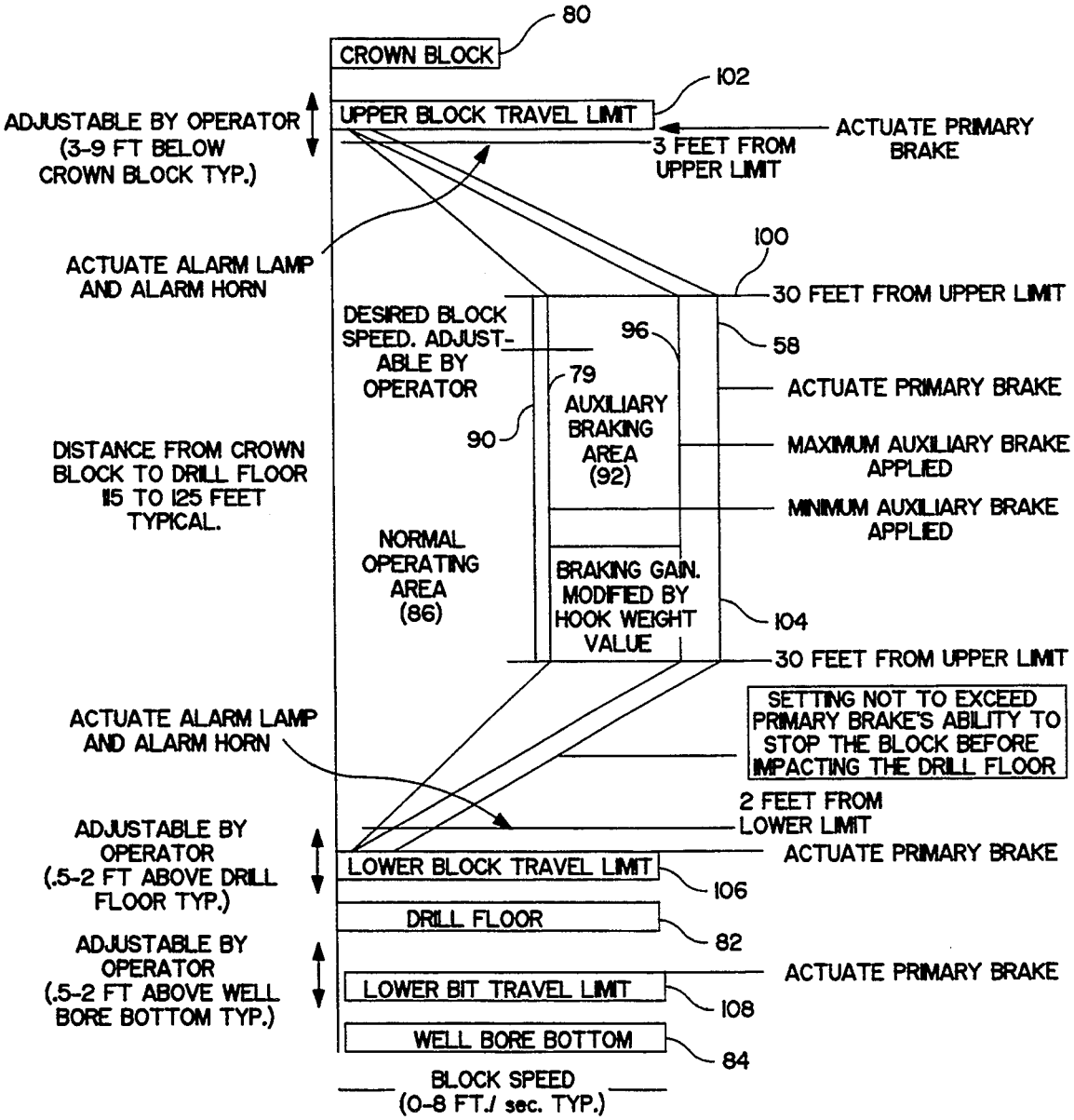

FIG. 3 is a diagram showing the typical relationship between the speed of the traveling block and its position relating to the limits of travel imposed by the drilling rig and the drilling bit.

DESCRIPTION OF THE PREFERRED EMBODIMENTS

Now referring to the drawings and first to FIG. 1, a typical drilling rig traveling block speed control system in accordance with the present invention is illustrated in block diagram form connected to a typical drilling rig. A vertically oriented drilling mast or derrick 1 supports at its upper end a usual crown block 2. Suspended from crown block 2 by a rope arrangement is a traveling block 3 for supporting hook structure 4. Alternatively, traveling block 3 can be formed as a conventional hook block. As will be recognized, the terms traveling "hook block", "hook", "block" and other such references generally refer to load bearing part 4 and related parts of the hoist assembly attached to the rope arrangement.

Associated with crown block 2 and traveling hook block 3 is hoisting rope 5, one end of which is securely fixed to ground by means of a dead line 6 and a dead line anchor 7. The other end of hoisting rope 5 forms a fast line 8 attached to drawworks 9. Drawworks 9 typically includes one or more electric motors 10 and a suitable drive transmission 11 connected to a generally cylindrical rotatable drum 12 for wrapping and unwrapping fast line 8 therearound, as required for operation. Depending on its operating mode, drum 12 is also referred to as the winding drum or the hoisting drum. Drawworks 9 also includes an auxiliary brake 19, such as an Elmageo eddy current brake manufactured by the Baylor Company. Brake 19 is connected to drive shaft 14 of the drawworks along with a primary friction brake 13, which is typically a band type brake. Brake 13 can be actuated either hydraulically or pneumatically as desired. Both are of standard manufacture and available for selection. A typical band brake actuation is disclosed, in this case including a pneumatic cylinder that is engaged by rig air pressure by way of an electronically actuated air valve.

The above-described apparatus and drilling rig is entirely conventional and well understood in the drilling art. In raising the hook block and the load attached thereto, motors 10 associated with drawworks 9 are activated to wind fast line 8 onto winding drum 12. Conversely, when hook 3 is to be lowered, electric motors 10 are disengaged and winding drum 12 is permitted to rotate so as to pay out the fast line under the retarding effect of auxiliary brake 19. In the event that a faster downward travel speed is desired, the braking action of brake 19 is reduced or even deenergized completely. On the other hand, if the downward travel of hook block 3 is to be slowed, the braking action of brake 19 can be increasingly energized. As is well understood in the art, primary friction brake 13 is typically operated by a primary brake operating lever and is typically employed for normal braking stops and slow feeding of the fast line from the drum 12.

As described above in the background description, the present invention is particularly directed at preventing runaway load conditions where the downward speed of travel of the hook block and its associated load is excessive. When excessive, a particular load as it is handled could inadvertently be manipulated in such a way to exceed the normal braking capability of primary brake 13 associated with the drawworks to stop the load. Thus, because of operator error or brake failure, the traveling block could impact the floor and not be stopped by the operator applying full braking by both primary brake 13 and auxiliary brake 19. Alternatively, the drill bit could impact the bottom of the hole and potentially cause great damage of the bit, the drill string, or other operatively related structure.

In the preferred embodiment of the invention, load sensing means in the form of a conventional load or force sensing transducer 15 attached to dead line anchor 7 produces an electrical signal on output line 20 that is representative of the tension on dead line 6 and, consequently, the load carried by hook block 3. Alternatively, a conventional load cell or other load measuring device can be associated with derrick 1 to provide an electrical output signal representative of the load carried by hook block 3.

Absolute block position sensor 17 comprises one or more linear displacement transducers that are each typically 30 feet in length. One such transducer is an MTS Temposonics model 031287091139. Each transducer or conductor is connected to an electronics head 17*a*, 17*b*, 17*c*, 17*d* or 17*e*. The transducers are aligned substantially end-to-end, although there is non-touching overlap of the ends to provide operational redundancy, as hereafter explained. The transducers are located in a protective sheath. The protective sheath comprises lengths of stainless steel tubing, vertically installed, end-to-end and is located alongside the travel path of the traveling block. Since the distance is generally more than 30 feet, more than one transducer is normally employed.

It is well know to persons of ordinary skill in the art, that a linear displacement transducer is a position measurement device that includes a waveguide having a wire passing through its inside and high resolution measurement detectors to detect the twisting movement of the waveguide. Movement of the waveguide is produced by the interaction of two magnetic fields, including one from a magnet passing along the outside of the wave guide and the other produced by a current pulse launched along the wire inside the waveguide.

Magnet marker 17*x* includes a generally U-shaped holder of a plurality of magnets, nominally 24 in a preferred embodiment, and is attached to the traveling block so as to be positioned at least 180° about the transducer sheath. The magnets are aligned in a horizontal plane to form magnetic marker 17*x* to produce a magnetic field at the location of the magnetic marker. Thus, when the conducting element of the linear displacement transducer of absolute block position sensor 17 is pulsed, the interaction of the magnetic field of the pulse with the magnetic field of the marker causes the waveguide of the linear displacement transducer to twist. The time elapse from pulse to twist reveals the position of the marker. In a preferred embodiment, the transducer reads the position from 4 to 32 times before the system checks the position of the block.

Magnetically actuated switch 21 is used to check the output of the position sensor when only one transducer is used. When more than one transducer is used, they are overlapped and form a means for checking each other where there is overlap.

The control system of the present invention includes an electrical connection 22 for controlling the actuation or application of auxiliary eddy current brake 19 and an electrical connection 24 for controlling the actuation or application of the brake band of primary friction brake 13.

A conventional signal processor 18, which is typically a general purpose digital computer, includes a control program represented by the flow diagram of FIG. 2 to produce an output control signal on electrical connection 22 (FIG. 1) to control the application of auxiliary brake 19 when the hook block position and/or the speed of the hook block reach predetermined levels. More specifically, processor 18 calculates from the load signal appearing on output line 20 and from the speed signal appearing on output line 23, a braking value that is applied to the traveling hook block to reduce the speed to the desired level for the position of the block at any given time. Should the calculated braking value speed for the position value exceed a predetermined level, processor 18 produces a control output 24 to actuate primary band brake 13.

The upward movement of the hook block is usually controlled by the application of a floor pedal (shown in FIG. 1) or a hand control by the driller. The processor also takes over the control of the throttle to reduce the throttle when the upward speed of the hook block exceeds a preprogrammed limit or when the upward speed and position of the hook block together are within ranges where throttle reduction is appropriate. Further details of this throttle operation are more fully set out below.

In the preferred processing arrangement or flow diagram illustrated in FIG. 2, the constant input parameters are first entered manually, or they can be included as part of the operating program. The input parameters can be entered by means of a conventional keyboard (not shown) using conventional digital I/O interface. A suitable processor 18 is the CR-10 processor made by Campbell Scientific, Inc. and its related power supply and controls, as described hereafter.

FIG. 2 is a flow diagram of the speed control system, with the processing steps being performed by processor 18 and related software in conventional fashion. Before the system is powered up, the system input constants are programmed into the processor by the software, by manual inputting and/or by the replacement of a computer component having the desired input constants included. These constants include the high or upper limit for the traveling block; the low limit or limits for the traveling block, which may include either or both the travel limit for the block with respect to the drill floor and the travel limit for the drill bit with respect to the bottom of the well bore; and the maximum speed of the traveling block independent of whether the block is approaching an upper or a lower limit.

Additional inputs that are normally inputted by the operator and not fixed by hardware or software, are the high stop position, the low stop position or positions, and the high and low position slow down positions or points. The operator normally selects the high stop position to be three to nine feet, which is the distance from the crown block where the traveling block will stop. The operator normally selects the low stop positions to be one-half to two feet, which is the distance where the traveling block will stop before it reaches the drill floor or before the drill bit reaches the bottom of the bore hole. The high and low slow down positions are normally selected to be about 30 feet prior to the respective high and low limits or stop locations, as desired.

For convenience, the diagram and discussion that follows refers to the upper and lower limits, but operation can just as easily be with respect to the upper and lower stop positions. Therefore, for purposes hereof, upper limit refers to either mode of operation. Likewise, as mentioned above, the slow down positions can be programmed to be either with respect to the limits or the stop positions; however, for convenience of description, will be referred to the limits. Therefore, it will be understood that the "limits" include the stop positions as well as the actual limits.

Thus, the system constants are all inputted into the flow at input system constants block 50. The variable values obtained from the components of the rig described in FIG. 1 are applied into the flow at input systems variables block 52. These variables include the block position, the hook weight and the bit position.

Now referring to the flow diagram in operation and specifically to FIGS. 2 and 3, after the system is powered up by turning on the power to the system at power up block 54, the system calculates the hook speed at block 56, which is the speed of the traveling block. The computer is programmed to run this calculation program on a definable timed execute cycle or interval. This means that the hook speed is calculated by comparing the present block position with the previous cycle or interval stored block position.

When the block is not moving, the weight of the hook is updated into the computer at block 58. By reading the hook weight only when the block is not moving, the hook weight reading is not affected by the moving mass.

With all of the conditions established, block 60 determines whether the traveling block position is within three feet of the upper travel limit for the traveling block. This is an upper cautionary limit and may be selected by the operator to be other than three feet, if desired. If the traveling block is within the upper cautionary limit, a suitable alarm lamp is lit and alarm horn is sounded (block 66).

If the traveling block is not within the upper cautionary limit, then it is determined if the block is within two feet of the traveling limit for the traveling block (block 62) or within two feet of the traveling limit for the drill bit with respect to the bottom of the hole (block 64). These are the respective lower cautionary limits and can be different from two feet, respectively, if the operator so desires. If the answer to the determination is "yes" in either case, again the alarm lamp will light and the alarm horn will be sounded (block 66).

If the block is such so that neither the upper cautionary limit is exceeded nor one of the lower cautionary limits are exceeded, the determination is made whether the block exceeds the lower block travel limit, which is typically 0.5–2 feet above the lower block limit, although again this limit is selectable by the operator. This calculation and determination is shown in block 68. If the answer is "yes", then the primary brake is actuated (block 70).

If the answer is "no" from block 68, then the determination is made whether the traveling block exceeds the upper travel limit, which is selectable by the operator, but is typically 3–9 feet from the upper limit for the traveling block. This is shown by block 72, which determination actuates the primary brake when the answer is "yes".

In like manner to the above, if the answers to both block 68 and 72 determinations are "no", then a determination is made whether the lower travel limit to the lower bit limit has been exceeded (block 74). This is again arbitrarily set at 2 feet, but can be selected at a different distance by the operator. If the answer is "yes", the primary brake is actuated, but if "no", then the inquiry characterized in block 76 is asked, namely, does the speed of the traveling block exceed the maximum speed limit for the traveling block regardless of position. If the answer is "yes", the primary brake is actuated. If the answer is "no", inquiry is then made as to whether the block is ascending (block 78).

Assuming that the ascending inquiry is answered affirmatively, a calculation is made at block 80 to determine if the ascending block or hook speed is approaching a limit when considered in combination with the position of the block. As the block nears the upper limit, the maximum speed is reduced to cause a throttle reduction. The result of various possible speeds vs. position calculations to result in predetermined throttle reductions are predetermined by the operating hardware and/or to produce a "yes" output from block 80 when appropriate. If "no" is the output from block 80, the output is applied to block 86, which will produce a "yes" output if a maximum speed setting is approached regardless of position. Thus, in either case a "yes" output from block 80 or 86 will cause throttle reduction calculation (block 82) to produce a suitable output as calculated to the throttle (block 84).

Following either a "no" signal from block 86 or an incremental throttle reduction occurrence from block 84, the interrogation of the entire system begins again.

When the answer to whether the block is ascending is "no" (block 78), inquiry is made as to whether the block speed vs. a lower limit position has been exceeded (block 90). Again, as the block gets closer to a lower limit (which is shown in simplified format in FIG. 2 since the lower limit can be either the lower block limit or the lower bit limit), the maximum speed requirement becomes less to result in the actuation of the primary brake (block 70).

If the answer from block 90 is "no", inquiry is made as to whether the speed and position are such to result in the actuation of the auxiliary (magnetic) brake by reaching a speed vs. block position calculation for such a result (block 92). If the answer is "yes", the amount of brake pressure is calculated (block 94) and applied to the auxiliary brake (block 88). Alternatively, when the block approaches a preset speed condition, regardless of position, then block 96 produces a "yes" signal to block 94. The preset and calculation controls are determined by hardware and/or software controls.

The flow diagram shown in FIG. 2 is a simplified diagram, as mentioned above, with respect to the fact that there are actually two lower limits instead of only one, as suggested by block 90. In addition, there are some secondary control lines omitted for simplicity of illustration. For example, a block will continue to descend after the application of the auxiliary brake so as to also cause the application of the primary brake under the conditions expressed above.

It should also be evident that reinquiry from the top of the diagram is made periodically or cyclically. The parameters can be reprogrammed by the operator when desired. Also, a manual switch can be provided for allowing the operator to take full control of operations and to effectively disconnect the automatic control operation represented by FIG. 2.

Now referring to the block control diagram, FIG. 3, additional information is illustrated for controlling the operation of the traveling block or hook as described heretofore. The vertical scale of this diagram is indicative of the vertical location of the traveling block with respect to its upper and lower limits. The upper limit is determined by crown block 80 and the lower limit is determined either by the location of the traveling block to drill floor 82 or the drill bit to well bore bottom 84. The diagram shows that the well bore bottom control position is lower than the drill floor control position; however, in any particular case, these control positions can be reversed and only one will be controlling, as discussed above with respect to block 64.

As noted on the left side of the diagram, the typical distance of the crown block to the drill floor is between 115 and 125 feet. It will be recognized that for any particular rig, this distance could be more or less than that distance. In Normal Operating Area, the block speed is operated typically up to about 8 feet per second. If the block is moving upward, a maximum ascending speed 90 is set so that when that speed is exceeded, regardless of block location, the throttle is cut back or reduced.

At an approach limit distance 100 that is about 30 feet from the upper limit, a position input is important as a triggering location for calculating whether a particular speed is within the normal operating area or within an area outside thereof such that there is throttling down and/or application of a brake. Note that lines 94, 96 and 98 all merge from their respective intersections with upper approach limit 100 to upper block travel limit 102. Limit 102 is typically 3 to 9 feet below crown block 80. Regardless of whether the primary brake was used to bring the traveling block to a stop while it was moving, it is actuated to keep the traveling block at its upper travel limit once it is in place. Also, an alarm lamp and alarm horn are actuated for the benefit of the operator and others when the traveling block is within about 3 feet of its upper block travel limit location.

In similar fashion, the auxiliary brake and, when appropriate, the primary brake is actuated when the traveling block is descending and reaches a speed outside of normal operating area 86. When lower approach limit 104 is reached, then a lesser speed is required for slow down actuation of the brake or brakes to achieve the desired deceleration. This is shown by the merging of the lines from approach limit 104 to either lower block travel limit 106 or lower bit travel limit 108. Again, in either event, when the lower block travel limit or the lower bit travel limit is reached, the primary brake is actuated. The lower limit that determines operation is the one that is reached first. Typically, lower block travel limit 106 is established at about 0.5–2 feet above the drill floor and lower bit travel limit 108 is established at about 0.5–2 feet above the bottom of the well bore.

The absolute block position apparatus is employed for producing the needed input signal for ensuring that the traveling block stops at upper block travel limit 102 position and at lower block travel limit 106 position.

An alarm lamp and/or an alarm horn can be activated when the traveling block approaches within 2 feet from the respective controlling lower limit.

It should be noted that the distances and speeds set forth in FIG. 3 are all typical values and can be set differently from those shown by the operator, if desired.

Moreover, a particular rig can be equipped only to operate with a part of the overall system, if desired. For example, the overall system operation includes the following parts (1) normal operating area control while block is ascending, (2) reducing control of block from approach limit 100 to stop, (3) normal operating area control while block is descending, (4) reducing control of block from approach limit 104 to stop determined by lower block travel limit 106 and (5) reducing control of block from approach limit 104 to stop determined by lower bit travel limit 108.

It should be further noted that the pulse interrogation arrangement for determining the absolute position of the magnetic marker is a function of the internal programming of the commercial sensor previously described. Generally, however, a number of four consecutive returns are taken at each interrogation cycle and a quotient reading is developed that produces an average reading, the procedure reducing the possibility of error to a very small number.

While several embodiments have been described and illustrated, it will be understood that the invention is not limited thereto since many modifications may be made and will become apparent to those skilled in the art.

What is claimed:

1. In an oil drilling rig of a type including
a derrick,
a traveling block, suspended form the derrick by a line connected to an anchor, facilitating upward and downward movement of a drill string and associated equipment into and out of a well bore, and
a prime mover including a rotatable drum on which the line, from which the traveling block is suspended, is wound,
the improvement in speed control apparatus, comprising
means for controlling the traveling block, including
means for controlling the rotatable drum of the prime mover,
means for producing a position signal representative of the position of the traveling block along its normal travel;
processor means, electrically connected to the rotatable drum controlling means and the position signal producing means, preprogrammed with instructions for automatically slowing the traveling block as it approaches an upper limit by utilizing a deceleration means connected to the prime mover to control the speed of the traveling block, including
means for calculating a speed signal from changes in said position signal, said speed signal being representative of the vertical speed of the block,
speed reduction control means utilizing said speed and position signals to produce a slowdown electrical signal for the deceleration means for controlling the prime mover to reducibly control the rate of travel of the traveling block.

2. Speed control apparatus in accordance with claim 1, additionally including,
a throttle means,
wherein said deceleration means is activated by said slowdown electrical signal to reduce the upward travel of the traveling block by gradually reducing the throttle means as needed in accordance with said preprogrammed instructions as selected by the speed of the traveling block at the time of initiation of said slowdown electrical signal.

3. Speed control apparatus in accordance with claim 2, wherein
said means for producing said position signal includes
a vertical conductor positioned along the travel path of the traveling block,
a magnetic marker attached to the traveling block so as to travel in proximity to said vertical conductor, and
an electronic pulse transceiver connected to one end of said vertical conductor for transmitting an interrogation pulse on said conductor and receiving a return reflection thereon indicative of the location of said magnetic marker so that said position means produces the position signal representative of the distance the traveling block is from the upper limit constituting a reading.

4. Speed control apparatus in accordance with claim 3, wherein
said vertical conductor comprises a plurality of vertical segments sequentially connected together, and
said transceiver receives the return reflection from each of said segments and recalibrates the indicative location of said magnetic marker as it passes each of said segments.

5. Speed control apparatus in accordance with claim 3, wherein
said magnetic marker includes a series of horizontally aligned individual magnetics arranged around more than 180 degrees of said vertical conductor.

6. Speed control apparatus in accordance with claim 3, wherein
said transceiver includes
pulse response means that produces an expanded output indicative of a predetermined number of successive readings initiated by the interrogation pulse, and
a divider circuit for dividing the expanded output by the predetermined number so that the position signal output is an average of the successive readings.

7. Speed control apparatus in accordance with claim 3, wherein
the production of a position signal within a preset period of time following said interrogation pulse produces a slowdown electrical signal, and wherein
said deceleration means causes the traveling block to stop within an upper limit range located within a predetermined distance of said upper limit, regardless of the travel block speed at the time of initiation of said slowdown signal.

8. Speed control apparatus in accordance with claim 1, and including
load measuring means connected to the anchor for producing a weight signal representative of the load of the drill string and associated equipment.

9. Speed control apparatus in accordance with claim 8, additionally including,
a throttle means,
wherein said speed reduction control means also utilizes said weight signal with said speed and position signals to produce said slowdown signal, and
said deceleration means is activated by said slowdown electrical signal to reduce the upward travel of the traveling block by gradually reducing the throttle means as needed in accordance with said preprogrammed instructions as selected by the speed of the traveling block at the time of initiation of said slowdown electrical signal.

10. Speed control apparatus in accordance with claim 9, wherein
said means for producing said position signal includes
a vertical conductor positioned along the travel path of the traveling block,
a magnetic marker attached to the traveling block so as to travel in proximity to said vertical conductor, and
an electronic pulse transceiver connected to one end of said vertical conductor for transmitting an interrogation pulse on said conductor and receiving a return reflection thereon indicative of the location of said magnetic marker so that said position means produces the position signal representative of the distance the traveling block is from the upper limit constituting a reading constituting a reading.

11. Speed control apparatus in accordance with claim 10, wherein said vertical conductor comprises a plurality of vertical segments sequentially connected together, and said transceiver receives a return reflection from each of said segments and recalibrates the indicative location of said magnetic marker as it passes each of said segments.

12. Speed control apparatus in accordance with claim 10, wherein said magnetic marker includes a series of horizontally aligned individual magnetics arranged around more than 180 degrees of said vertical conductor.

13. Speed control apparatus in accordance with claim 10, wherein said transceiver includes pulse response means that produces an expanded output indicative of a predetermined number of successive readings initiated by the interrogation pulse, and a divider circuit for dividing the expanded output by the predetermined number so that the position signal output is an average of the successive readings.

14. Speed control apparatus in accordance with claim 10, wherein the production of a position signal within a preset period of time following said interrogation pulse produces a slowdown electrical signal, and wherein said deceleration means causes the traveling block to stop within an upper limit range located within a predetermined distance of said upper limit, regardless of the travel block speed at the time of initiation of said slowdown signal.

15. Speed control apparatus in accordance with claim 14, wherein the traveling block depends from a crown block on the drilling rig and wherein said upper limit range defines a range such that the crown block is not contacted by the traveling block.

16. Speed control apparatus in accordance with claim 15, wherein said processor means includes means for adjusting said upper limit range.

17. Speed control apparatus in accordance with claim 9, wherein said deceleration means includes the throttle means and at least one brake connected to said prime mover operable when said slowdown signal is above a predetermined limit.

18. Speed control apparatus in accordance with claim 9, and including an alarm means connected to said speed reduction control means for producing an alarm signal when said speed, position, and weight signals exceed a predetermined alarm combination condition.

19. Speed control apparatus in accordance with claim 9, and including indicator means connected to receive said position signal for providing a display of actual traveling block position.

20. In an oil drilling rig of a type including a derrick, a traveling block, suspended from the derrick by a line connected to an anchor, facilitating upward and downward movement of a drill string and associated equipment into and out of a well bore, and a prime mover including a rotatable drum on which the line, from which the traveling block is suspended, is wound, the improvement in speed control apparatus, comprising means for controlling the traveling block, including means for controlling the rotatable drum of the prime mover, means for producing a position signal representative of the position of the traveling block along its normal travel;

processor means, electrically connected to the rotatable drum controlling means and the position signal producing means, preprogrammed with instructions for automatically slowing the traveling block as it approaches a lower limit by utilizing a deceleration means connected to the prime mover to control the speed of the traveling block, including means for calculating a speed signal from changes in said position signal, said speed signal being representative of the vertical speed of the block, and speed reduction control means utilizing said speed and position signals to produce a slowdown electrical signal for the deceleration means for controlling the prime mover to reducibly control the rate of travel of the traveling block.

21. Speed control apparatus in accordance with claim 20, wherein said deceleration means is activated by said slowdown electrical signal to reduce the downward travel of the traveling block by application of a magnetic break connected to the prime mover in accordance with said preprogrammed instructions as selected by the speed of the traveling block at the time of initiation of said slowdown electrical signal.

22. Speed control apparatus in accordance with claim 21, wherein said means for producing said position signal includes a vertical conductor positioned along the travel path of the traveling block, a magnetic marker attached to the traveling block so as to travel in proximity to said vertical conductor, and an electronic pulse transceiver connected to one end of said vertical conductor for transmitting an interrogation pulse on said conductor and receiving a return reflection thereon indicative of the location of said magnetic marker so that said position means produces the position signal representative of the distance the traveling block is from the lower limit constituting a reading.

23. Speed control apparatus in accordance with claim 22, wherein said vertical conductor comprises a plurality of vertical segments sequentially connected together, and said transceiver receives the return reflection from each of said segments and recalibrates the indicative location of said magnetic marker as it passes each of said segments.

24. Speed control apparatus in accordance with claim 22, wherein said magnetic marker includes a series of horizontally aligned individual magnetics arranged around more than 180 degrees of said vertical conductor.

25. Speed control apparatus in accordance with claim 22, wherein said transceiver includes pulse response means that produces an expanded output indicative of a predetermined number of successive readings initiated by the interrogation pulse, and a divider circuit for dividing the expanded output by the predetermined number so that the position signal output is an average of the successive readings.

26. Speed control apparatus in accordance with claim 22, wherein the production of a position signal within a preset period of time following said interrogation pulse produces a slowdown electrical signal, and wherein said deceleration means causes the traveling block to stop within a lower limit range located within a predetermined distance of said lower limit, regardless of the travel block speed at the time of initiation of said slowdown signal.

27. Speed control apparatus in accordance with claim 20, and including load measuring means connected to the anchor for producing a weight signal representative of the load of the drill string and associated equipment.

28. Speed control apparatus in accordance with claim 27, wherein said speed reduction control means also utilizes said weight signal with said speed and position signals to produce said slowdown signal, and said deceleration means is activated by said slowdown electrical signal to reduce the downward travel of the traveling block by application of a magnetic break connected to the prime mover in accordance with said preprogrammed instructions as selected by the speed of the traveling block at the time of initiation of said slowdown electrical signal.

29. Speed control apparatus in accordance with claim 28, wherein said means for producing said position signal includes a vertical conductor positioned along the travel path of the traveling block, a magnetic marker attached to the traveling block so as to travel in proximity to said vertical conductor, and an electronic pulse transceiver connected to one end of said vertical conductor for transmitting an interrogation pulse on said conductor and receiving a return reflection thereon indicative of the location of said magnetic marker so that said position means produces the position signal representative of the distance the traveling block is from the lower limit constituting a reading.

30. Speed control apparatus in accordance with claim 29, wherein said vertical conductor comprises a plurality of vertical segments sequentially connected together, and said transceiver receives a return reflection from each of said segments and recalibrates the indicative location of said magnetic marker as it passes each of said segments.

31. Speed control apparatus in accordance with claim 29, wherein said magnetic marker includes a series of horizontally aligned individual magnetics arranged around more than 180 degrees of said vertical conductor.

32. Speed control apparatus in accordance with claim 29, wherein said transceiver includes pulse response means that produces an expanded output indicative of a predetermined number of successive readings initiated by the interrogation pulse, and a divider circuit for dividing the expanded output by the predetermined number so that the position signal output is an average of the successive readings.

33. Speed control apparatus in accordance with claim 29, wherein the production of a position signal within a preset period of time following said interrogation pulse produces a slowdown electrical signal, and wherein said deceleration means causes the traveling block to stop within a lower limit range located within a predetermined distance of said lower limit, regardless of the travel block speed at the time of initiation of said slowdown signal.

34. Speed control apparatus in accordance with claim 33, wherein the drilling rig includes a drilling floor above which the traveling block must operate and said lower limit range defines a range such that the traveling block does not contact said drilling floor.

35. Speed control apparatus in accordance with claim 34, wherein said processor means includes means for adjusting said lower limit range.

36. Speed control apparatus in accordance with claim 33, and including a sensor for producing a signal indicative of the distance the bottom of a drill bit connected to the bottom of the drill string is from the bottom of the hole, and wherein said lower range is defined as the first to occur between first and second bottom trigger ranges, said first bottom trigger range being such that the traveling block does not contact said drilling floor and said second bottom trigger range being such that the drill bit does not contact the bottom of the hole.

37. Speed control apparatus in accordance with claim 28, wherein said deceleration means includes a primary brake and at least one auxiliary brake operable when said slowdown signal is above a predetermined limit to prevent said primary brake from dissipating energy in excess of its normal rating.

38. Speed control apparatus in accordance with claim 28, and including an alarm means connected to said speed reduction control means for producing an alarm signal when said speed, position, and weight signals exceed a predetermined alarm combination condition.

39. Speed control apparatus in accordance with claim 28, and including indicator means connected to receive said position signal for providing a display of actual traveling block position.

40. In an oil drilling rig of a type including a derrick, a traveling block, suspended from the derrick by a line connected to an anchor, facilitating upward and downward movement of a drill string and associated equipment into and out of a well bore, and a prime mover including a rotatable drum on which the line, from which the traveling block is suspended, is wound, the improvement in speed control apparatus, comprising means for controlling the traveling block, including means for controlling the rotatable drum of the prime mover, means for producing a position signal representative of the position of the traveling block along its normal travel; and processor means, electrically connected to the rotatable drum controlling means and the position signal producing means, preprogrammed with instructions for automatically slowing the traveling block as it approaches an upper limit and as it approaches a lower limit by utilizing a deceleration means connected to the prime mover to control the speed of the traveling block, including means for calculating a speed signal from changes in said position signal, said speed signal being representative of the vertical speed of the block, and speed reduction control means utilizing said speed and position signals to produce a first slowdown electrical signal for the deceleration means for controlling the prime mover to reducibly control the upward rate of travel of the traveling block when said position signal indicates a predetermined closeness to said upper limit and a second slowdown electrical signal for the deceleration means for controlling the prime mover to reducibly control the downward rate of travel of the traveling block when said position signal indicates a predetermined closeness to said lower limit.

41. Speed control apparatus in accordance with claim 40, and including load measuring means connected to the anchor for producing a weight signal representative of the load of the drill string and associated equipment.

42. Speed control apparatus in accordance with claim 41, additionally including, a throttle means, wherein said speed reduction control means also utilizes said weight signal with said speed and position signals to produce said first and second slowdown signals, and said deceleration means is upward-motion activated by said first slowdown electrical signal to reduce the upward travel of the traveling block by gradually reducing the throttle means as needed in accordance with said preprogrammed instructions as selected by the speed of the traveling block at the time of initiation of said first slowdown electrical signal and is downward-motion activated by said second slowdown electrical signal to reduce the downward travel of the traveling block by application of a magnetic break connected to the prime mover in accordance with said preprogrammed instruction as selected by the speed of the traveling block at the time of initiation of said second slowdown electrical signal.

43. Speed control apparatus in accordance with claim 41, wherein, when said traveling block is moving upwardly, said speed reduction control means monitors and utilizes said speed, position, and weight signals to produce a first slowdown electrical signal before said position signal indicates a predetermined closeness to said upper limit when the combination of said speed, position, and weight signals exceeds a first predetermined combination value, and wherein, when said traveling block is moving downwardly, said speed reduction control means monitors and utilizes said speed, position, and weight signals to produce a second slowdown electrical signal before said position signal indicates a predetermined closeness to said lower limit when the combination of said speed, position, and weight signals exceeds a second predetermined combination value.

44. Speed control apparatus in accordance with claim 40, and including a sensor for producing a signal indicative of the distance the bottom of a drill bit connected to the bottom of the drill string is from the bottom of the hole, and wherein said lower limit is defined as the first to occur between first and second bottom trigger limits, said first bottom trigger limit being such as to prevent the traveling block from contacting said drilling floor and said second bottom trigger limit being such as to prevent the drill bit from contacting the bottom of the hole.

45. In an oil drilling rig of a type including a derrick, a traveling block, suspended from the derrick by a line connected to an anchor, facilitating upward and downward movement of a drill string and associated equipment into and out of a well bore, and a prime mover including a rotatable drum on which the line, from which the traveling block is suspended, is wound, the improvement in speed control apparatus, comprising means for controlling the rotatable drum of the prime mover, means for producing a position signal representative of the position of the traveling block along its normal travel;

means for calculating a speed signal from changes in said position signal, said speed signal being representative of the vertical speed of the block, and speed reduction control means utilizing said speed position signal to produce a slowdown electrical signal for automatically controlling the speed of the prime mover to reducibly control the rate of travel of the traveling block.

46. Speed control apparatus in accordance with claim 45, wherein said speed reduction control means produces a slowdown electrical signal when said speed signal exceeds a first predetermined speed value regardless of said position signal.

47. Speed control apparatus in accordance with claim 46, wherein said prime mover includes deceleration means activated by said slowdown electrical signal.

48. The method of controlling the speed of the traveling block of an oil drilling rig, which comprises producing a position signal for the traveling block, preprogramming a control processor with instructions for automatically slowing down the traveling block as it approaches an upper limit so as to produce a slowdown signal inversely dependent on speed within a speed range for the traveling block, calculating a speed signal from changes in said position signal as being representative of the vertical speed of the traveling block, and inputting said control processor with said position and speed signals so that when a specific position signal is applied corresponding to a predetermined position before said upper limit, a respective value of said slowdown signal is produced by said control processor that corresponds to the value of said speed signal existing at the same time for controlling the deceleration of the traveling block.

49. The method of controlling the speed of the traveling block in accordance with claim 48, wherein the deceleration of the traveling block is slowed to a stop within a predetermined upper limit range.

50. The method of controlling the speed of the traveling block in accordance with claim 48, and including measuring the load carried by the traveling block and producing a weight signal corresponding thereto, and inputting said control processor with said weight signal to modify the value of said slowdown signal so that the larger said weight signal becomes, the larger will be said slowdown signal.

51. The method of controlling the speed of the traveling block of an oil drilling rig, which comprises producing a position signal for the traveling block by directly sensing its vertical position in the drilling rig, preprogramming a control processor with instructions for automatically slowing down the traveling block as it approaches a lower limit so as to produce a slowdown signal inversely dependent on speed within a speed range for the traveling block, calculating a speed signal from changes in said position signal as being representative of the vertical speed of the traveling block, and inputting said control processor with said position and speed signals so that when a specific position signal is applied corresponding to a predetermined position before said lower limit, a respective value of said slowdown signal is produced by said control processor that corresponds to the value of said speed signal existing at the same time for controlling the deceleration of the traveling block.

52. The method of controlling the speed of the traveling block in accordance with claim 51, wherein the deceleration of the traveling block is slowed to a stop within a predetermined lower limit range.

53. The method of controlling the speed of the traveling block in accordance with claim 51, and including measuring the load carried by the traveling block and producing a weight signal corresponding thereto, and inputting said control processor with said weight signal to modify the value of said slowdown signal so that the larger said weight signal becomes, the larger will be said slowdown signal.

54. The method of controlling the speed of the traveling block of an oil drilling rig, which comprises producing a position signal for the traveling block by directly sensing its vertical position in the drilling rig, preprogramming a control processor with instructions for automatically slowing down the traveling block as it approaches an upper limit so as to produce a first slowdown signal inversely dependent on speed within a first speed range for the traveling block and for automatically slowing down the traveling block as it approaches a lower limit so as to produce a second slowdown signal inversely dependent on speed within a second speed range for the traveling block, calculating a speed signal from changes in said position signal as being representative of the vertical speed of the traveling block, and inputting said control processor with said position and speed signals so that when a first specific position signal is applied corresponding to a first predetermined position before said upper limit, a respective value of said first slowdown signal is produced by said control processor that corresponds to the value of said speed signal existing at the same time for controlling the deceleration of the traveling block as it approaches the upper limit and so that when a second specific position signal is applied corresponding to a second predetermined position before said lower limit, a respective value of said slowdown signal is produced by said control processor that corresponds to the value of said speed signal existing at the same time for controlling the deceleration of the traveling block as it approaches the lower limit.

55. The method of controlling the speed of the traveling block in accordance with claim 54, and including measuring the load carried by the traveling block and producing a weight signal corresponding thereto, and inputting said control processor with said weight signal to modify the value of each said first and second slowdown signals so that the larger said weight signal becomes, the larger will be said first and second slowdown signals.

56. The method of controlling the speed of the traveling block of an oil drilling rig, which comprises producing a position signal for the traveling block by directly sensing its vertical position in the drilling rig, calculating a speed signal form changes in said position signal as being representative of the vertical speed of the traveling block, inputting a control processor so that when a predetermined specific speed signal is reached, said control processor produces a deceleration signal for automatically controlling the deceleration of the traveling block.

* * * * *